US009263206B2

(12) United States Patent
Ahlert et al.

(10) Patent No.: US 9,263,206 B2
(45) Date of Patent: Feb. 16, 2016

(54) SWITCHING DEVICE

(71) Applicant: SIEMENS AKTIENGESELLSCHAFT, Munich (DE)

(72) Inventors: Torsten Ahlert, Fuerstenwalde (DE); Jörg-Uwe Dahl, Werder (DE); Thomas Leye, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 84 days.

(21) Appl. No.: 13/933,164

(22) Filed: Jul. 2, 2013

(65) Prior Publication Data

US 2014/0055902 A1 Feb. 27, 2014

(30) Foreign Application Priority Data

Aug. 21, 2012 (DE) ..... 10 2012 214 826

(51) Int. Cl.
*H01H 9/30* (2006.01)
*H01H 1/20* (2006.01)
*H01H 9/34* (2006.01)

(52) U.S. Cl.
CPC ..... *H01H 9/30* (2013.01); *H01H 1/2058* (2013.01); *H01H 9/342* (2013.01)

(58) Field of Classification Search
CPC ..... H01H 1/2058; H01H 9/342; H01H 9/346
USPC ..... 218/13, 30, 31, 35, 43, 47, 155, 156, 218/157; 335/201, 202, 47, 88; 361/115
See application file for complete search history.

(56) References Cited

U.S. PATENT DOCUMENTS

| | | | | |
|---|---|---|---|---|
| 5,796,061 | A * | 8/1998 | Fabrizi et al. | 218/157 |
| 6,239,398 | B1 * | 5/2001 | Doughty et al. | 218/22 |
| 6,480,082 | B1 | 11/2002 | Aihara | |
| 8,487,204 | B2 * | 7/2013 | Scola et al. | 218/157 |
| 2005/0219021 | A1 | 10/2005 | Fleege | |
| 2012/0168405 | A1 | 7/2012 | Anglade | |
| 2013/0062317 | A1 | 3/2013 | Muders et al. | |
| 2013/0234812 | A1 * | 9/2013 | Dahl | 335/201 |

FOREIGN PATENT DOCUMENTS

| | | | |
|---|---|---|---|
| DE | 69711504 | T2 | 9/2002 |
| DE | 69926982 | T2 | 6/2006 |
| DE | 102011101238 | A1 | 12/2011 |
| GB | 2178596 | A | 2/1987 |
| WO | WO 03050835 | A1 | 6/2003 |
| WO | WO 2011033182 | A2 | 3/2011 |

* cited by examiner

*Primary Examiner* — Renee Luebke
*Assistant Examiner* — William Bolton
(74) *Attorney, Agent, or Firm* — Harness, Dickey & Pierce, P.L.C.

(57) ABSTRACT

A switching device, in particular an electrical power circuit breaker, is disclosed for protecting an electrical circuit. The switching device includes two pole terminals, a switching mechanism for automatically interrupting the electrical connection of the two pole terminals in the event of an overload, electrical components for controlling the switching device and a pole cassette in which the switching mechanism is disposed in a switching chamber. The pole cassette includes at least one gas duct which is connected to the switching chamber in a gas-communicating manner and is designed to discharge gas from the pole cassette past the electrical components to the environment.

14 Claims, 2 Drawing Sheets

SWITCHING DEVICE

PRIORITY STATEMENT

The present application hereby claims priority under 35 U.S.C. §119 to German patent application number DE 102012214826.4 filed Aug. 21, 2012, the entire contents of which are hereby incorporated herein by reference.

FIELD

At least one embodiment of the present invention generally relates to a switching device, in particular an electrical power circuit breaker, for protecting an electrical circuit.

BACKGROUND

Switching devices are well known in principle. They are used as protection for electrical circuitry whereby pole terminals of the switching device are separated from one another in the event of an overload. The breaking of this electrical connection serves to prevent damage to components and devices disposed in the electrical circuit. For this purpose known switching devices often have a switching mechanism of rotary design. The rotatable switching arms of such a switching mechanism can connect and disconnect a fixed contact and a movable contact. Redundancy is often provided, so that a double arm can be brought into contact with two corresponding fixed contacts on both sides of an axis of rotation as a movable contact.

The disadvantage of known switching devices is that, when the contacts are opened in the event of an overload, an arc is often generated. This arc causes gas to be produced which must leave the switching chamber of the switching mechanism.

In known switching devices, a duct implemented in the enclosure or in the pole cassette is basically provided for this purpose. The gas produced by the arc during the switching process can leave the switching chamber via this duct. However, in the case of known switching devices such as those disclosed in U.S. Pat. No. 6,480,082 B1, for example, protection of the electrical components of the switching device is unknown. Thus the danger there is basically that the gas, which is not or only inadequately discharged, will cause contamination inside the switching chamber, particularly in the vicinity of electrical components.

If, for example, a duct is provided in the switching device enclosure, this enclosure duct must be sealed to the switching chamber. The danger of this seal as a predetermined fracture point at the high switching pressures is that gas and therefore contamination will impair electrical components for controlling the switching device. As this fouling is mainly electrically conductive contamination, this may result in undesirable short circuit situations in the electrical components and therefore damage or even destruction of the switching device.

SUMMARY

At least one embodiment of the present invention is directed to at least partially eliminating at least one of the above described disadvantages of known switching devices. At least one embodiment of the present invention is directed to a switching device, in particular a power circuit breaker, which will prevent contamination of electrical components of the switching device, in particular caused by plasma or gas formation during switching processes, in an inexpensive and simple manner.

Further features and details of the invention will emerge from the sub-claims, the description and the accompanying drawings. Features and details described in connection with the switching device according to at least one embodiment of the invention self-evidently also apply in connection with the inventive sub-claims and vice versa, so that reference is always made or can always be made reciprocally in respect of the disclosure concerning the individual aspects of the invention.

A switching device according to at least one embodiment of the invention is implemented in particular as an electrical power circuit breaker. It is used to protect an electrical circuit and has two pole terminals. A switching mechanism for automatically interrupting the electrical connection of the two pole terminals in an overload situation is additionally provided. A switching device according to at least one embodiment of the invention also has electrical components for controlling the switching device. A pole cassette is additionally provided in which the switching mechanism is disposed in a switching chamber. The pole cassette consequently has said switching chamber for mounting the switching mechanism. In a switching device according to at least one embodiment of the invention, the pole cassette has at least one gas duct which is connected to the switching chamber in a gas-communicating manner. The gas duct is designed to discharge gas from the pole cassette past the electrical components to the environment.

A switching device according to at least one embodiment of the invention can be further developed by making the pole cassette of multi-part design. In particular, the pole cassette comprises two half-shells, the individual components of the pole cassette being interconnected. The multi-part design of the pole cassette reduces the cost. Thus, in particular, two pole half-shells can be manufactured particularly inexpensively and simply. A connection is established e.g. using fasteners in the form of bolts or rivets. Adhesive bonding and/or welding are also possible within the scope of the invention. It is advantageous if the connection of the individual components of the pole cassette can withstand high pressures. Thus, in particular pressures in excess of 20 MPa are likely when the switching mechanism operates. The material of the pole cassette and in particular also the connection of the individual components are preferably designed such that they are able to withstand such high pressures. The type of said connection is matched to the materials used for the individual components.

BRIEF DESCRIPTION OF THE DRAWINGS

The present invention will now be explained in greater detail with reference to the accompanying drawings. The terms "left", "right", "upper" and "lower" relate to an orientation of the drawings with normally readable reference characters.

DETAILED DESCRIPTION OF THE EXAMPLE EMBODIMENTS

Figure 1:
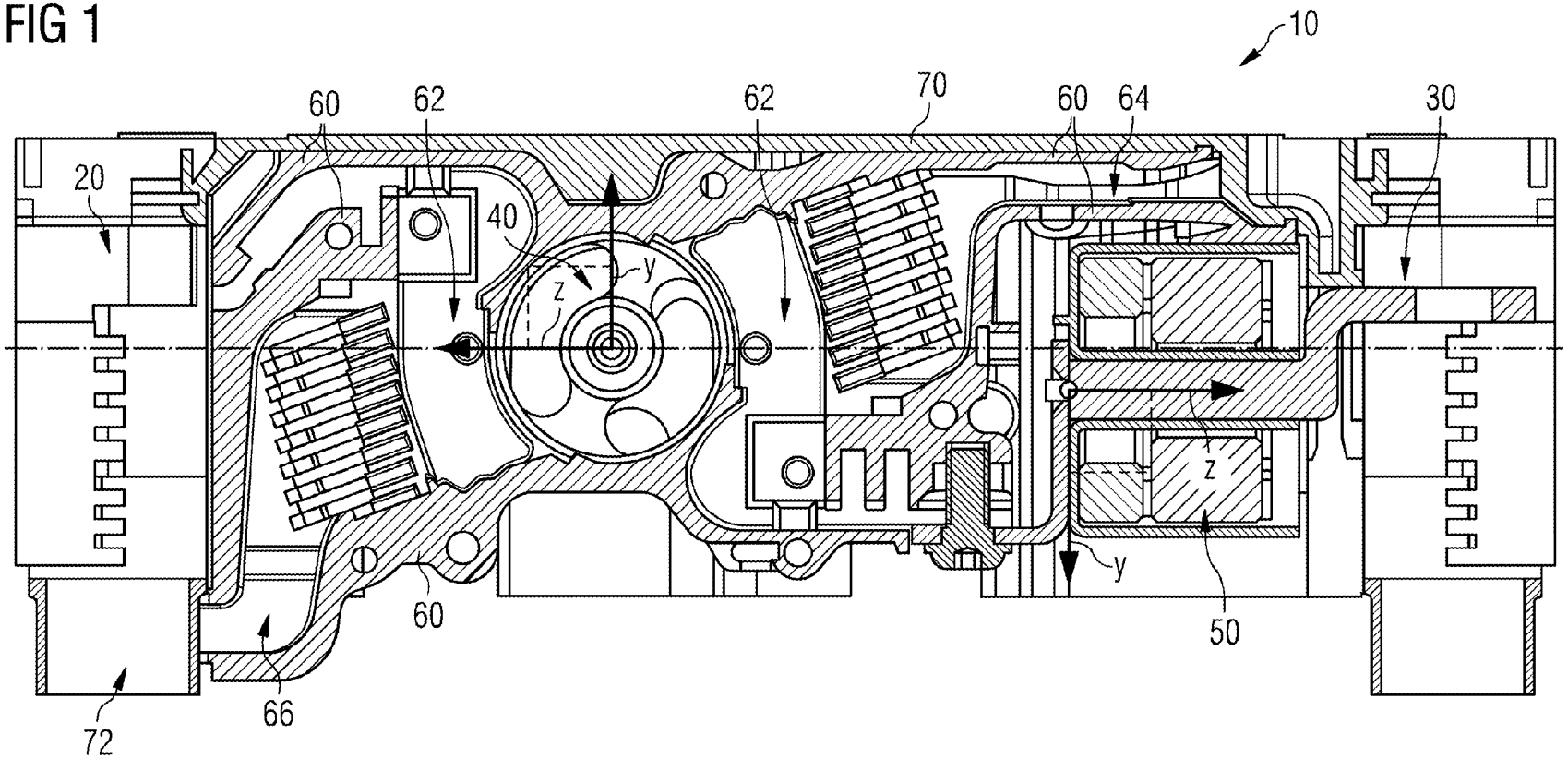
FIG. 1 schematically illustrates an embodiment of a switching device.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

A switching device according to at least one embodiment of the invention is implemented in particular as an electrical power circuit breaker. It is used to protect an electrical circuit and has two pole terminals. A switching mechanism for automatically interrupting the electrical connection of the two pole terminals in an overload situation is additionally provided. A switching device according to at least one embodiment of the invention also has electrical components for controlling the switching device. A pole cassette is additionally provided in which the switching mechanism is disposed in a switching chamber. The pole cassette consequently has said switching chamber for mounting the switching mechanism. In a switching device according to at least one embodiment of the invention, the pole cassette has at least one gas duct which is connected to the switching chamber in a gas-communicating manner. The gas duct is designed to discharge gas from the pole cassette past the electrical components to the environment.

According to at least one embodiment of the invention, two pole terminals are therefore provided so that the switching device can be part of an electrical circuit. It is used to protect against overload situations such as may occur, for example, in the event of shorting of the electrical circuit. The switching mechanism can be implemented e.g. as a rotary switching mechanism, and therefore have in particular one or more movable contacts or correspondingly one or more fixed contacts. By rotation, the electrical connection of the two pole terminals can be made or broken. The electrical components for controlling the switching device are in particular components which react sensitively in respect of electrically conductive contamination. These can be transistors, resistors, circuit boards or even more complex electrical components. These electrical components are not disposed inside the pole cassette is which the switching mechanism is accommodated in the switching chamber, but outside the pole cassette.

In a switching device according to at least one embodiment of the invention, the gas duct is implemented in the pole cassette. Thus, said gas duct can be provided by the geometry of the pole cassette as a free flow cross-section via which a gas-communicating connection can be established directly or indirectly between the environment and the switching chamber. In terms of at least one embodiment of the present invention, direct discharging of the gas to the environment means that one end of the gas duct opens into the switching chamber and the other end into the environment of the switching device. Indirect discharging is when one end of the gas duct opens into the switching chamber and the other end leads to a transfer point to a gas discharge duct. Said gas discharge duct can be disposed or implemented in the enclosure of the switching device, for example.

An important aspect, however, is that in the context of at least one embodiment of the present invention the gas duct in the pole cassette has at least one extension enabling the gas to be conveyed past the electrical components. In the case of indirect discharge to the environment, the gas is not therefore transferred to a downstream gas discharge duct until the gas has passed the electrical components through the gas duct. The electrical components are therefore protected and possible weak points in the form of interfacing seals between gas duct and gas discharge duct are located geometrically after the passing of the electrical components.

Another advantage with at least one embodiment of the present invention is that the gas duct in the pole cassette can be made of a particularly tough material. Thus, for example, a duroplastic material can be used to implement the entire pole cassette and therefore also the gas duct. The high switching pressures occurring when an arc is struck can be effectively absorbed in this way. A duroplastic material for the pole cassette and therefore for the gas duct can be endowed with higher thermal stability without involving high costs, so that thermal stabilization is also possible at the high switching temperatures for the switching device according to at least one embodiment of the invention.

The contamination caused by the gas produced when the pole terminals are separated is in particular an electrically conductive carbon deposit. This is effectively kept away from the electrical components by the inventive implementation of the duct, so that short-circuiting of the electrical components is effectively eliminated over a large number of switching processes or rather the probability thereof can be reduced.

Self-evidently, the switching device can also have additional components, in particular an enclosure. Such an enclosure closes off the switching device externally and has inside it a compartment for accommodating both the pole cassette and, separately therefrom, preferably the electrical components.

A switching device according to at least one embodiment of the invention can be further developed by making the pole cassette of multi-part design. In particular, the pole cassette comprises two half-shells, the individual components of the pole cassette being interconnected. The multi-part design of the pole cassette reduces the cost. Thus, in particular, two pole half-shells can be manufactured particularly inexpensively and simply. A connection is established e.g. using fasteners in the form of bolts or rivets. Adhesive bonding and/or welding are also possible within the scope of the invention. It is advantageous if the connection of the individual components of the pole cassette can withstand high pressures. Thus, in particular pressures in excess of 20 MPa are likely when the switching mechanism operates. The material of the pole cassette and in particular also the connection of the individual components are preferably designed such that they are able to withstand such high pressures. The type of said connection is matched to the materials used for the individual components.

For a switching device according to at least one embodiment of the invention it is also advantageous to implement the components of the pole cassette so that they are sealed off from one another at least in sections. In particular, this seal can take the form of a groove/spring connection. The seal acts in respect of the high pressures during switching such that, even at such high pressures, the switching gas is prevented from leaving the gas duct. A seal in the form of a groove/spring connection is particularly advantageous, as it is inexpensive and simple to manufacture. It also obviates the need for additional components in the form of sealing means such as e.g. O-rings. In addition, these groove/spring connections can be implemented as a guide, so that the sealing effect is automatically produced when the individual components of the pole cassette are assembled. The seal is therefore to be understood in particular in respect of an undesirable escape of gas from the gas duct. However, within the scope of the present invention, seals using additional sealing means are also self-evidently possible.

It is likewise advantageous if, in a switching device according to at least one embodiment of the invention, the pole cassette is made at least in sections from a material with high mechanical strength to resist the pressures occurring when the switching mechanism switches. This can be in particular a duroplastic material. The high mechanical strength results in a resistance to the high switching pressures in a region in excess of approximately 20 MPa. Additionally or alternatively it is also possible for the material to have high thermal stability. In particular, temperatures of up to 5000 K must be mentioned as a thermal load. However, the thermal loads are only very briefly present, for a matter of milliseconds, so that greater emphasis is placed on the mechanical strength in respect of the switching pressures occurring. Self-evidently, these pressures can be changed, in particular reduced, by enlarging the free flow cross-section of the gas duct. Preferably, therefore, more than one gas duct is also provided, so that a large total flow cross-section can be made available which allows rapid discharge and therefore enables the switching pressures to be reduced.

A further advantage can be achieved if, for a switching device according to at least one embodiment of the invention, the pole cassette is surrounded by an enclosure in which not only the pole cassette but also the electrical components are disposed. Such an enclosure can be implemented particularly inexpensively within the scope of the present invention. Thus, an injection-molded thermoplastic material can be used for manufacturing the enclosure in a simple and low-cost manner. The enclosure protects both the pole cassette and also the electrical components. The electrical components are therefore disposed outside the pole cassette, but inside the enclosure. The enclosure therefore constitutes a single unit of the switching device which can be implemented particularly advantageously in respect of mounting in a switchgear cabinet. Such an enclosure can also have mechanical interfaces for use in a support of a switchgear cabinet.

Another advantage for a switching device according to at least one embodiment of the invention is for the enclosure to have a gas discharge duct which is in gas-communicating connection with the gas duct of the pole cassette. This is a variant involving the already described indirect discharging of the gas from the switching chamber. Transfer of the gas from the gas duct into the gas discharge duct therefore takes place. This transfer point or rather the interface between gas duct and gas discharge duct is preferably sealed, as will be explained in greater detail in the following paragraph. The position of this interface is arranged such that the gas duct and therefore also the gas flowing therein have already passed the electrical components. This interface is preferably geometrically oriented such that even in the event of a partial leak at the interface, the gas cannot travel in the direction of the electrical components, thereby effectively preventing contamination of the electrical components by the switching gas even if this interface is poorly or ineffectively sealed.

It is likewise advantageous if, for a switching device according to at least one embodiment of the invention, the interface between the gas duct and the gas discharge duct is sealed. This seal can also be provided by the corresponding geometric design of the two mating faces. Thus a shape of groove and spring and correspondingly a groove/spring connection is conceivable. The provision of separate sealing means, e.g. O-rings, is also possible within the scope of at least one embodiment of the present invention.

A switching device according to at least one embodiment of the present invention can be advantageously further developed such that the gas duct has a fluidically optimized inner contour at least in sections. Implementing the gas duct in the pole cassette makes this particularly inexpensive and simple to achieve, as no interfaces to other ducts have to be taken into account in this section of the gas path. Fluidic optimization is to be understood in particular in relation to a tripping mechanism which can be disposed in the gas duct. This tripping mechanism is tripped by the gas guided in the gas duct flowing against it, so that improving the incident flow and therefore increasing the flow pressure result in more reliable tripping of the tripping mechanism. A corresponding optimization in respect of the free flow cross-section can also take place within the scope of at least one embodiment of the present invention. Thus, by increasing the free flow cross-section, an increase in the flow rate and therefore a reduction in the switching pressure can be achieved.

Another advantage is for the gas duct in a switching device according to at least one embodiment of the invention to have a rectangular or essentially rectangular free flow cross-section. The advantage of a rectangular or essentially rectangular free flow cross-section is that the free flow cross-section is maximized, i.e. enlarged, with minimal space requirement. As has already been explained, the switching pressure can be reduced by enlarging the free flow cross-section. This reduces to the same extent the risk of damage to the gas duct or rather the risk of leakage at any sealing points present.

It is likewise advantageous if, in a switching device according to at least one embodiment of the invention, at least one second gas duct is disposed in the pole cassette and is connected in a gas-communicating manner to the switching chamber. This second gas duct is designed to discharge gas from the switching chamber in another direction, in particular essentially in an opposite direction to the other gas duct. The second gas duct is therefore preferably in a position in which it does not have to be routed past electrical components. In this way the free flow cross-section can be further increased and therefore the pressure ratio occurring during the switching situation can be reduced.

FIG. 1 shows a schematic cross-sectional view of an embodiment of a switching device 10 according to the invention. This embodiment of the switching device 10 comprises a switching mechanism 40 which is implemented as a rotary switching mechanism. Not shown in greater detail are fixed contacts and movable contacts which can be opened and closed by rotation of the switching mechanism 40. The switching mechanism 40 is disposed in a switching chamber 62 of a pole cassette 60. Said switching chamber is a free volume in which gas produced by an arc when the contacts of the switching mechanism 40 are opened can propagate. In order to discharge the gas, a first gas duct 64 and a second gas duct 66 are provided. It is critical that at least the first gas duct 64 is provided. This leads up to the right, away from the switching chamber 62 and transfers (not shown) the discharged gas to the environment. This transfer of the switching gas can take place directly or indirectly, as will be explained in greater detail below.

As can also be seen from FIG. 1, the switching device 10 is an embodiment having an enclosure 70. The enclosure 70 completely surrounds the pole cassette 60. Additionally provided in the enclosure 70 are electrical components 50 which allow the switching device 10, in particular the switching mechanism 40, to be controlled. The two pole terminals 20 and 30 are schematically represented at both ends left and right of the switching device 10. These two pole terminals 20 and 30 are electrically interconnected, wherein this electrically conductive connection can be interrupted via the switching mechanism 40.

As FIG. 1 clearly shows, although the electrical components 50 are inside the enclosure 70, they are outside the pole cassette 60. It can also be clearly seen that the gas duct 64 implemented in the pole cassette 60 runs past the electrical components 50 on the upper side of the electrical components 50. This obviates the need for a transfer point, which must be sealed, adjacent to the electrical components 50. Thus, by providing the gas duct 64 in the pole cassette 60, in the event of possible seal leakage, gas can be effectively prevented from traveling toward the electrical components and contaminating them.

At the left-hand lower end of the switching device 10, a second gas duct 66 is provided which has a transfer point to a gas discharge duct 72 of the enclosure 70. This additional second gas duct 66 increases the free flow cross-section so that the pressure occurring when the switching mechanism 40 switches can be reduced.

Figure 2:
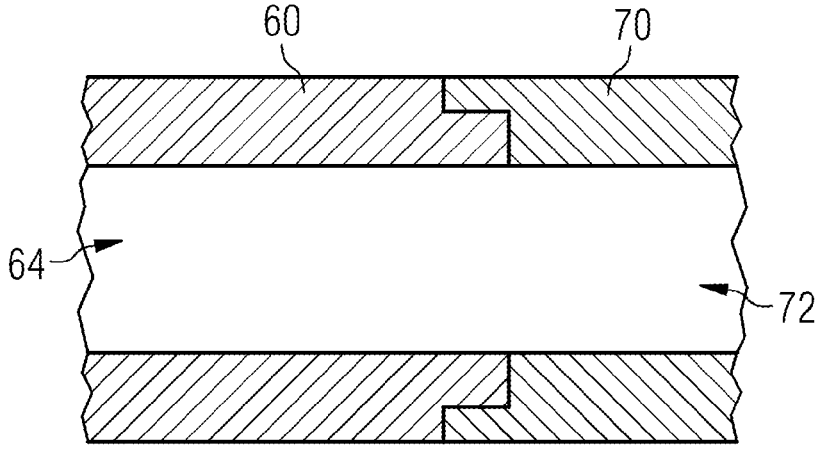
FIG. 2 schematically illustrates an embodiment of a connection between gas duct and gas discharge duct and FIG. 3 schematically illustrates an embodiment of a pole cassette.

FIG. 2 shows a possible embodiment of an interface between a gas duct 64 and a gas discharge duct 72 which is disposed in the enclosure 70. There is an overlap here, so that this transfer point is already sealed by the geometric design of this interface. Said transfer point between pole cassette 60 and enclosure 70 is in a position where the gas inside the gas duct 64 has already passed the electrical components 50. There is therefore no longer the danger that, in the event of leakage or partial leakage of this interface as shown in FIG. 2, the electrical components 50 will be fouled by gas and correspondingly electrically conductive contamination.

Figure 3:
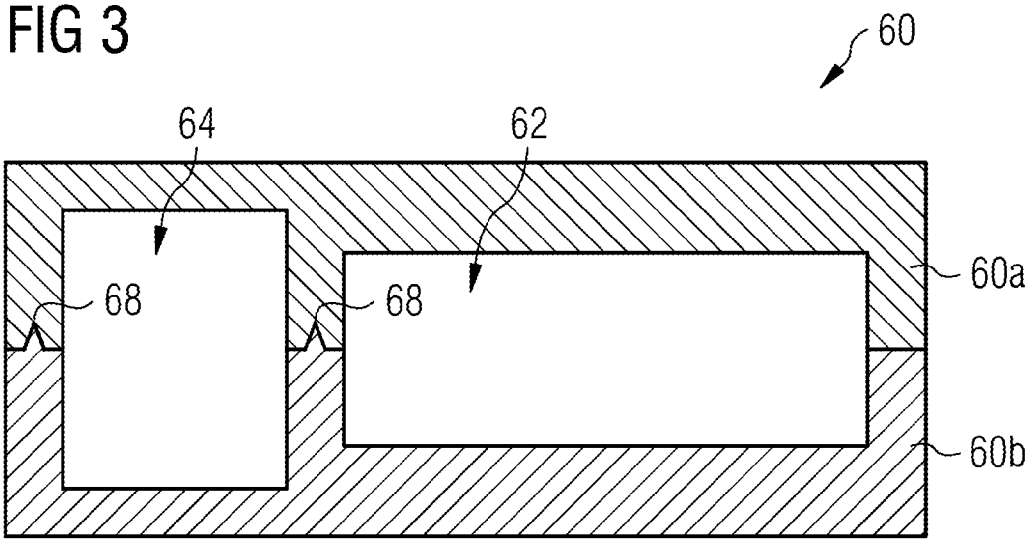

FIG. 3 schematically shows a cross-section through an embodiment of a pole cassette 60. In this embodiment the pole cassette 60 consists of two pole half-shells 60*a* and 60*b*, forming therebetween the switching chamber 62 in which the switching mechanism 40 can be accommodated. The gas duct 64 is likewise formed between the two pole half-shells 60*a* and 60*b*. FIG. 3 likewise clearly shows that the sealing of the gas duct 64 between the two half-shells 60*a* and 60*b* is provided by a groove/spring connection 68. This enables these two pole half-shells 60*a* and 60*b* to be assembled particularly inexpensively and simply while at the same time ensuring a reliable seal.

The foregoing explanation of the embodiments describes the present invention merely by way of examples. Self-evidently, individual features of the embodiments may be freely combined with one another, where technically feasible, without departing from the scope of the present invention.

LIST OF REFERENCE CHARACTERS

10 switching device
20 pole terminal
30 pole terminal
40 switching mechanism
50 electrical components

60 pole cassette
60*a* pole half-shell
60*b* pole half-shell
62 switching chamber
64 gas duct
66 second gas duct
68 groove/spring connection
70 enclosure
72 gas discharge duct

What is claimed is:

1. A switching device for protecting an electrical circuit, comprising:

two pole terminals;

a switching mechanism configured to automatically interrupt an electrical connection of the two pole terminals in the event of an overload;

electrical components configured to control the switching device;

a pole cassette; and an enclosure configured to house the pole cassette and the electrical components, the switching mechanism being disposed in a switching chamber of the pole cassette, the electrical components being disposed in the enclosure such that the electrical components are outside of the pole cassette and between the switching chamber and one of the two pole terminals, the pole cassette including at least one gas duct connected to the switching chamber in a gas-communicating manner, at least a portion of the at least one gas duct extending in the enclosure beyond the switching chamber and along one side of the electrical components such that the electrical components are isolated from gas flowing from the pole cassette to the environment by guiding the gas beyond the electrical components.

2. The switching device of claim 1, wherein the pole cassette is of multi-part design, and wherein individual components of the multi-part design of the pole cassette are interconnected.

3. The switching device of claim 2, wherein the components of the pole cassette are mutually sealed at least in sections.

4. The switching device of claim 2, wherein the pole cassette comprises two pole half-shells.

5. The switching device of claim 3, wherein the components of the pole cassette are mutually sealed at least in sections, by way of a groove/spring connection.

6. The switching device of claim 1, wherein the pole cassette is made, at least in sections, of a material having high mechanical resistance to the pressures occurring when the switching mechanism switches.

7. The switching device of claim 6, wherein the pole cassette is made of a duroplastic material.

8. The switching device of claim 1, wherein the enclosure includes a gas discharge duct connected in a gas-communicating manner to the at least one gas duct of the pole cassette.

9. The switching device of claim 8, wherein the interface between the at least one gas duct and the gas discharge duct is sealed.

10. The switching device of claim 1, wherein the at least one gas duct includes a fluidically optimized inner contour at least in sections.

11. The switching device of claim 1, wherein the at least one gas duct includes a rectangular or essentially rectangular free flow cross-section at least in sections.

12. The switching device of claim 1, wherein at least one second gas duct is disposed in the pole cassette and is connected to the switching chamber in a gas-communicating manner, the second gas duct being designed to discharge gas from the switching chamber in a direction different from the at least one gas duct.

13. The switching device of claim 12, wherein the at least one second gas duct is designed to discharge gas from the switching chamber in essentially an opposite direction from the at least one gas duct.

14. The switching device of claim 1, wherein the switching device is an electrical power circuit breaker.

* * * * *